US012544874B2

(12) United States Patent
Miyazaki et al.

(10) Patent No.: US 12,544,874 B2
(45) Date of Patent: Feb. 10, 2026

(54) APPARATUS FOR DOUBLE-SIDE POLISHING WORK

(71) Applicant: SUMCO CORPORATION, Tokyo (JP)

(72) Inventors: Yuji Miyazaki, Saga (JP); Masaru Morita, Saga (JP)

(73) Assignee: SUMCO CORPORATION, Tokyo (JP)

( * ) Notice: Subject to any disclaimer, the term of this patent is extended or adjusted under 35 U.S.C. 154(b) by 471 days.

(21) Appl. No.: 17/913,558

(22) PCT Filed: Dec. 28, 2020

(86) PCT No.: PCT/JP2020/049078

§ 371 (c)(1),
(2) Date: Sep. 22, 2022

(87) PCT Pub. No.: WO2021/192477

PCT Pub. Date: Sep. 30, 2021

(65) Prior Publication Data

US 2023/0106784 A1 Apr. 6, 2023

(30) Foreign Application Priority Data

Mar. 23, 2020 (JP) ..... 2020-050736

(51) Int. Cl.
*B24B 37/013* (2012.01)
*B24B 37/08* (2012.01)
*B24B 37/28* (2012.01)

(52) U.S. Cl.
CPC ..... *B24B 37/013* (2013.01); *B24B 37/08* (2013.01); *B24B 37/28* (2013.01)

(58) Field of Classification Search
CPC ..... B24B 37/013; B24B 37/08; B24B 37/28; B24B 37/12; B24B 37/205; B24B 49/12; H01L 21/67092
See application file for complete search history.

(56) References Cited

U.S. PATENT DOCUMENTS 6,458,014 B1 * 10/2002 Ihsikawa ..... B24B 37/205 451/526
7,137,867 B2 * 11/2006 Nagayama ..... B24B 49/04 451/10

(Continued)

FOREIGN PATENT DOCUMENTS

CN 107160288 9/2017
JP 2005-32849 2/2005

(Continued)

OTHER PUBLICATIONS

Inoue Y Publication May 18, 2016 retrieved translation from Espacenet: https://worldwide.espacenet.com/patent/search/family/049594356/publication/JP5917994B2?q=JP5917994B2 (Year: 2016).*

(Continued)

*Primary Examiner* — Monica S Carter
*Assistant Examiner* — Christopher Soto
(74) *Attorney, Agent, or Firm* — Greenblum & Bernstein, P.L.C.

(57) ABSTRACT

In a double-side polishing apparatus includes at least one work thickness measuring instrument in real time during double-side polishing of the work; an inner circumferential surface defined by the through hole in said one of the upper plate and the lower plate is provided with a metal cylindrical member; and either of: a lower window provided in a lower part of the cylindrical member provided in the upper plate and an upper window provided in an upper part of the cylindrical member provided to cover the upper side of the through hole provided in the upper plate, or an upper window provided in an upper part of the cylindrical member provided in the lower plate and a lower window provided to cover the lower side of the through hole provided in the lower plate.

5 Claims, 3 Drawing Sheets

(56) References Cited

U.S. PATENT DOCUMENTS

| | | | | |
|---|---|---|---|---|
| 2008/0099443 | A1 | 5/2008 | Benvegnu et al. | |
| 2015/0262893 | A1 * | 9/2015 | Nakamura | H01L 22/26 438/10 |
| 2017/0355060 | A1 | 12/2017 | Park | |

FOREIGN PATENT DOCUMENTS

| | | | | |
|---|---|---|---|---|
| JP | 5917994 | B2 * | 5/2016 | B24B 49/02 |
| JP | 2017-189849 | | 10/2017 | |
| JP | 2017209744 | A * | 11/2017 | B24B 37/07 |
| JP | 6490818 | | 3/2019 | |
| JP | 2019-181632 | | 10/2019 | |
| KR | 10-2017-0117878 | | 10/2017 | |
| KR | 10-2017-0132667 | | 12/2017 | |
| TW | I224036 | | 11/2004 | |
| TW | 201741072 | | 12/2017 | |
| WO | 03/041909 | | 5/2003 | |
| WO | 2019/198343 | | 10/2019 | |

OTHER PUBLICATIONS

Inoue Y Publication Nov. 30, 2017 retrieved translation from Espacenet: https://worldwide.espacenet.com/patent/search/family/060425135/publication/JP2017209744A?q=JP2017209744A (Year: 2017).*

Office Action issued in Corresponding CN Patent Application No. 202080098991.5, dated Aug. 1, 2024, along with an English translation thereof.

Office Action issued in Corresponding CN Patent Application No. 202080098991.5, dated Feb. 27, 2024, along with an English translation thereof.

Office Action issued in Corresponding Taiwanese Patent Appl. No. 109146177, dated Aug. 21, 2021, along with an English translation thereof.

International Search Report issued in International Patent Application No. PCT/JP2020/049078, dated Mar. 16, 2021, along with an English translation thereof.

International Preliminary Report on Patentability issued in International Patent Application No. PCT/JP2020/049078, dated Sep. 22, 2022, along with an English translation thereof.

Office Action issued in Corresponding CN Patent Application No. 202080098991.5, dated Nov. 20, 2024, along with an English translation thereof.

Office Action issued in Corresponding KR Patent Application No. 10-2022-7027863, dated May 22, 2024, along with an English translation thereof.

* cited by examiner

APPARATUS FOR DOUBLE-SIDE POLISHING WORK

TECHNICAL FIELD

This disclosure relates to an apparatus for double-side polishing a work.

BACKGROUND

In the production of a semiconductor wafer such as a silicon wafer, which is a typical example of a work to be polished, in order to obtain a wafer having flatness quality or surface smoothness quality controlled with higher precision, a double-side polishing process is typically used, by which front and back surfaces of the wafer are polished simultaneously.

Especially in recent years, semiconductor devices have been miniaturized and the diameter of semiconductor wafers has been increased, so that the flatness required of semiconductor wafers during light exposure has become more severe. Given this background, it is important to terminate polishing in a timely manner, and the timing for terminating polishing has been controlled by an operator by adjusting the polishing time.

However, the adjustment of the polishing time performed by an operator has been significantly influenced by polishing conditions such as the replacement period for the indirect materials for polishing and the differences in timing for apparatus deactivation. Accordingly, the polishing amount cannot always be controlled accurately, so it has largely relied on the experience of the operator.

To address this problem, the present applicant has proposed a technique of providing a through hole in an upper plate (or a lower plate) and measuring the thickness of a work through the through hole using a measurement system in real time during polishing (for example, JP 2019-181632 A (PTL 1)).

CITATION LIST

Patent Literature

PTL 1: JP 2019-181632 A

SUMMARY

Technical Problem

However, in the technique disclosed in PTL 1, the provision of a through hole would reduce measurement accuracy, for example, because of soil attached to the surface of a window, and thus would necessitate cleaning to prevent this, increasing the running cost.

It could therefore be helpful to provide a double-side polishing apparatus for a work, which can reduce soil attachment in a path for measuring the thickness of a work.

Solution to Problem

This disclosure primarily includes the following features.

(1) A double-side polishing apparatus for a work, comprising rotating surface plates having an upper plate and a lower plate, a sun gear provided at a center portion of the rotating surface plates, an internal gear provided around the rotating surface plates, and a carrier plate provided between the upper plate and the lower plate provided with at least one opening for holding a work, wherein one of the upper plate and the lower plate has at least one through hole penetrating from the upper surface to the lower surface of said one of the upper plate and the lower plate, the double-side polishing apparatus for a work further comprises at least one work thickness measuring instrument that can measure a thickness of the work through the at least one through hole in real time during double-side polishing of the work, an inner circumferential surface defined by the through hole in said one of the upper plate and the lower plate is provided with a metal cylindrical member, and the double-side polishing apparatus for a work further comprises either of:

a lower window provided in a lower part of the cylindrical member provided in the upper plate and an upper window provided in an upper part of the cylindrical member provided to cover the upper side of the through hole provided in the upper plate, or an upper window provided in an upper part of the cylindrical member provided in the lower plate and a lower window provided to cover the lower side of the through hole provided in the lower plate.

(2) The double-side polishing apparatus for a work, according to (1) above, further comprising one of an upper member fixed to an upper portion of the upper plate and a lower member fixed to a lower portion of the lower plate.

(3) The double-side polishing apparatus for a work, according to (2) above, wherein the upper member and the lower member are made of SUS.

(4) The double-side polishing apparatus for a work, according to (2) or (3) above, wherein a part of the upper member is placed on an upper surface of the cylindrical member, and the upper window is provided on the upper member; or a part of the lower member is placed on a lower surface of the cylindrical member, and the lower window is provided on the lower member.

(5) The double-side polishing apparatus for a work, according to any one of (1) to (4) above, wherein at least one vent that makes the through hole communicate with the outside is provided.

(6) The double-side polishing apparatus for a work, according to any one of (1) to (5) above, wherein the lower window is bonded to the lower part of the cylindrical member provided in the upper plate using an adhesive layer made of an adhesive; or the upper window is bonded to the upper part of the cylindrical member provided in the lower plate using an adhesive layer made of an adhesive.

(7) The double-side polishing apparatus for a work, according to any one of (1) to (6) above, wherein a recessed part is provided in the outer circumferential surface of the cylindrical member provided on the inner circumferential surface of the upper plate and an O ring is placed in the recessed part, or a recessed part is provided in the outer circumferential surface of the cylindrical member provided on the inner circumferential surface of the lower plate.

Advantageous Effect

This disclosure can provide a double-side polishing apparatus for a work, which can reduce soil attachment in a path for measuring the thickness of a work.

DETAILED DESCRIPTION

Embodiments of the double-side polishing apparatus for a work, according to this disclosure will now be described in detail with reference to the drawings.

Figure 1:
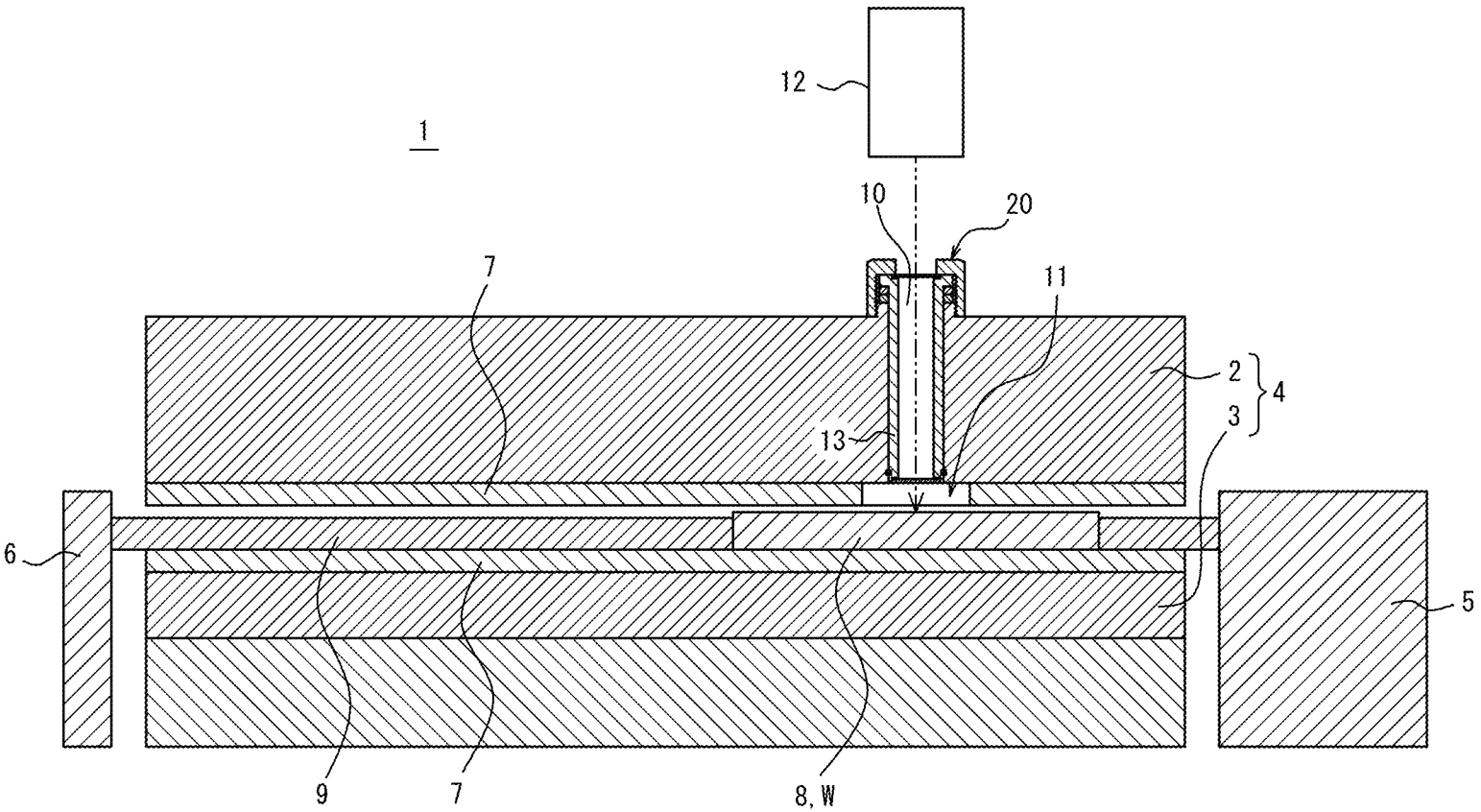
FIG. 1 is a diagram illustrating an example of a double-side polishing apparatus for a work, according to one embodiment of this disclosure.

FIG. 1 is a diagram illustrating an example of a double-side polishing apparatus for a work, according to one embodiment of this disclosure. As illustrated in FIG. 1, a double-side polishing apparatus 1 includes rotating surface plates 4 having an upper plate 2 and an opposite lower plate 3; a sun gear 5 provided at the center of rotation of the rotating surface plates 4; and an internal gear 6 provided in an annular shape around the rotating surface plates 4. As illustrated in FIG. 1, the surfaces of the upper and lower rotating plates 4 that face each other, namely, the bottom surface of the upper plate 2 that is a polishing surface and the upper surface of the lower plate 3 that is a polishing surface are each provided with a polishing pad 7 attached thereto.

Further, as depicted in FIG. 1, the double-side polishing apparatus 1 includes a carrier plate 9 between the upper plate 2 and the lower plate 3, and the carrier plate 9 has at least one retainer opening 8 for holding a work W. The double-side polishing apparatus 1 has only one carrier plate 9 in the illustration; alternatively, it may have a plurality of carrier plates 9. In the illustration, a work (a wafer in this embodiment) W is held in the retainer opening 8.

Now, the double-side polishing apparatus 1 can rotate the sun gear 5 and the internal gear 6 to cause planetary motion involving the orbital motion and the rotational motion of the carrier plate 9. Specifically, as described above, while supplying a polishing slurry, the carrier plate 9 is made to perform planetary motion and at the same time, the upper plate 2 and the lower plate 3 are relatively rotated with respect to the carrier plate 9, thereby making the polishing pads 7 attached to the upper and lower rotating surface plates 4 rubbed against the surfaces of the wafer W held in the retainer opening 8 in the carrier plate 9; thus, both surfaces of the wafer W can be polished simultaneously.

Further, as illustrated in FIG. 1, in the double-side polishing apparatus 1 of this embodiment, the upper plate 2 is provided with at least one through hole 10 penetrating from the upper surface of the upper plate 2 to the bottom surface thereof that is a polishing surface. In the illustration, one through hole 10 is placed at a position passing over the retainer opening 8 (wafer W) around the wafer's center. In this example, the through hole 10 is provided in the upper plate 2. Alternatively, the through hole may be provided in the lower plate 3. Specifically, at least one through hole 10 is provided in one of the upper plate 2 and the lower plate 3. Although one through hole 10 is provided in the example illustrated in FIG. 1, a plurality of through holes may be placed for example on the periphery of one circle on the upper plate 2. As illustrated in FIG. 1, an opening 11 penetrates the polishing pad 7 attached to the upper plate 2 as well at a position corresponding to the through hole 10, and penetrates from the upper surface of the upper plate 2 to the lower surface of the polishing pad 7. In the illustration, the diameter of the opening 11 is larger than the diameter of the through hole 10, yet may be smaller or the same as the diameter of the through hole 10.

Further, a work thickness measuring instrument 12 is provided above the through hole 10, and the thickness of the wafer W can be measured in real time through the through hole 10 and the opening 11 during double-side polishing of the wafer W. The work thickness measuring instrument 12 may be, for example, a wavelength tunable infrared laser measuring instrument. Such a measuring instrument can measure the thickness of the wafer W by evaluating the interference between light reflected off the front surface of the wafer W and the light reflected off the back surface thereof.

Figure 2:
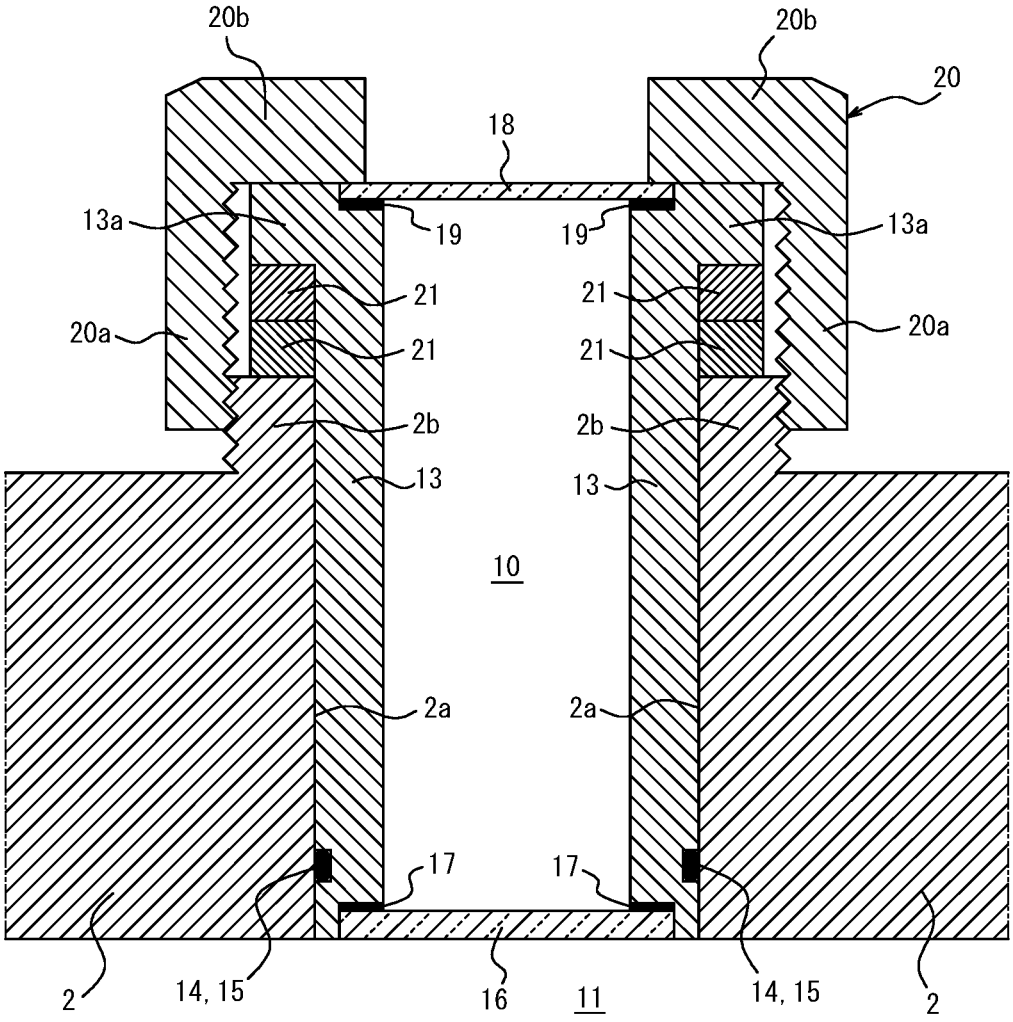
FIG. 2 is a diagram illustrating the main part of the double-side polishing apparatus in FIG. 1.

FIG. 2 is a diagram illustrating the main part of the double-side polishing apparatus in FIG. 1.

As illustrated in FIG. 1 and FIG. 2, in this embodiment, an inner circumferential surface 2*a* defined by the through hole 10 in the upper plate 2 is provided with a cylindrical member 13 made of metal (made of SUS in this example). In this example, the outer circumferential surface of the cylindrical member 13 is provided with a (annular) recessed part 14, and an O ring (annular ring) 15 (for example made of rubber) is placed in the recessed part 14, thus the O ring 15 encloses the space between the inner circumferential surface 2*a* of the upper plate 2 and the cylindrical member 13, and the backflow of the polishing slurry is prevented.

Further, as illustrated in FIG. 1 and FIG. 2, the double-side polishing apparatus 1 further includes a lower window 16 provided in a lower part of cylindrical member 13 provided in the upper plate 2. In the illustration, the lower window 16 having a plate shape is placed in a recessed part formed to have an annular shape at the lower end of the cylindrical member 13. The upper surface of the lower window 16 and the lower surface of the cylindrical member 13 that is defined by the above recessed part are bonded together using an adhesive layer 17. The lower window 16 may be made of, for example, a transparent acrylic material. The adhesive layer 17 may use, for example, an adhesive layer made of a silicone-based or modified silicone-based adhesive.

Further, as illustrated in FIG. 1 and FIG. 2, the double-side polishing apparatus 1 also includes an upper window 18 provided to cover the upper side of the through hole 10 provided in the upper plate 2. In the illustration, the upper window 18 having a plate shape is placed in a recessed part formed to have an annular shape at the upper end of the cylindrical member 13. A gasket 19 is placed between the lower surface of the upper window 18 and the lower surface of the cylindrical member 13 that is defined by the recessed part, and is forced down by an upper member 20 to be described below, thus the upper window 18 is fixed. The upper window 18 may be made of, for example, a transparent acrylic material. The gasket 19 may be made of, for example, rubber, and the thickness of the gasket 19 may be, for example, but not limited to 1.0 mm to 3.0 mm.

Further, as illustrated in FIG. 1 and FIG. 2, in this example, the upper plate 2 has a projecting part 2*b* that protrudes upward from the top. The double-side polishing apparatus 1 further includes the upper member 20 fixed to an upper portion of the upper plate 2. In the illustration, the upper member 20 is made up of a portion 20*a* extending in up and down directions and a portion 20*b* extending in the radial direction (of the through hole 10). In the illustration, the outer side surface of the projecting part 2*b* of the upper plate 2 (screw thread) and the inner side surface of the above portion 20*a* (nut thread) are fastened together. In the illustration, the cylindrical member 13 has a portion 13*a* at its upper end that protrudes radially outward, and the lower surface of the upper plate 2 and the lower surface of the cylindrical member 13 are aligned by controlling the thickness of washers 21 placed between the projecting portion 13*a* and the projecting part 2*b*, thus the strength of the fixation between an upper portion of the upper plate 2 and the upper member 20 can be controlled. As illustrated in FIG. 1 and FIG. 2, a part of the upper member (part 20*b* in the illustration) is placed on the upper surface of the cylindrical member 13. The upper member 20 may be made of for example SUS, but not limited thereto.

The operation and effect of the double-side polishing apparatus of this embodiment will be described below.

The double-side polishing apparatus 1 of this embodiment is chiefly provided with the through hole 10 in the upper plate 2, the opening 11 in the polishing pad 7, the lower window 16, and the upper window 18 as described above, and includes the work thickness measuring instrument 12, thus the thickness of the work (wafer in this example) can be measured in real time by the work thickness measuring instrument 12 through the upper window 18, the through hole 10 in the upper plate 2, the opening 11 in the polishing pad 7, and the lower window 16 during double-side polishing. Since the double-side polishing apparatus 1 of this embodiment is provided with the upper window 18, the attachment of soil (for example dust etc.) to the lower window 16 in a path for measuring the thickness of a work can be reduced.

Further, the double-side polishing apparatus 1 of this embodiment is provided with the cylindrical member 13 made of metal (SUS in this example) on the inner circumferential surface 2*a* defined by the through hole 10 in the upper plate 2, and is provided with the lower window 16 provided in a lower part of the cylindrical member 13 provided in the upper plate 2 and the upper window 18 provided to cover the upper side of the through hole 10 provided in the upper plate 2. As described above, since the lower window 16 and the upper window 18 are provided on the cylindrical member 13 but not on the surface plate, the windows can easily be replaced, which can reduce the running cost including the cost for cleaning; moreover, the backflow of the polishing slurry can be even more inhibited and the windows can be prevented from being coming off using an adhesive, for example, a strong adhesive such as a silicone-based or modified silicone-based adhesive. Further, since the cylindrical member 13 is made of metal (SUS in this example), favorable processing accuracy is achieved, and accurate processing by which the measurement accuracy is improved (for example, such as horizontally placing the window) can be performed.

Figure 3:
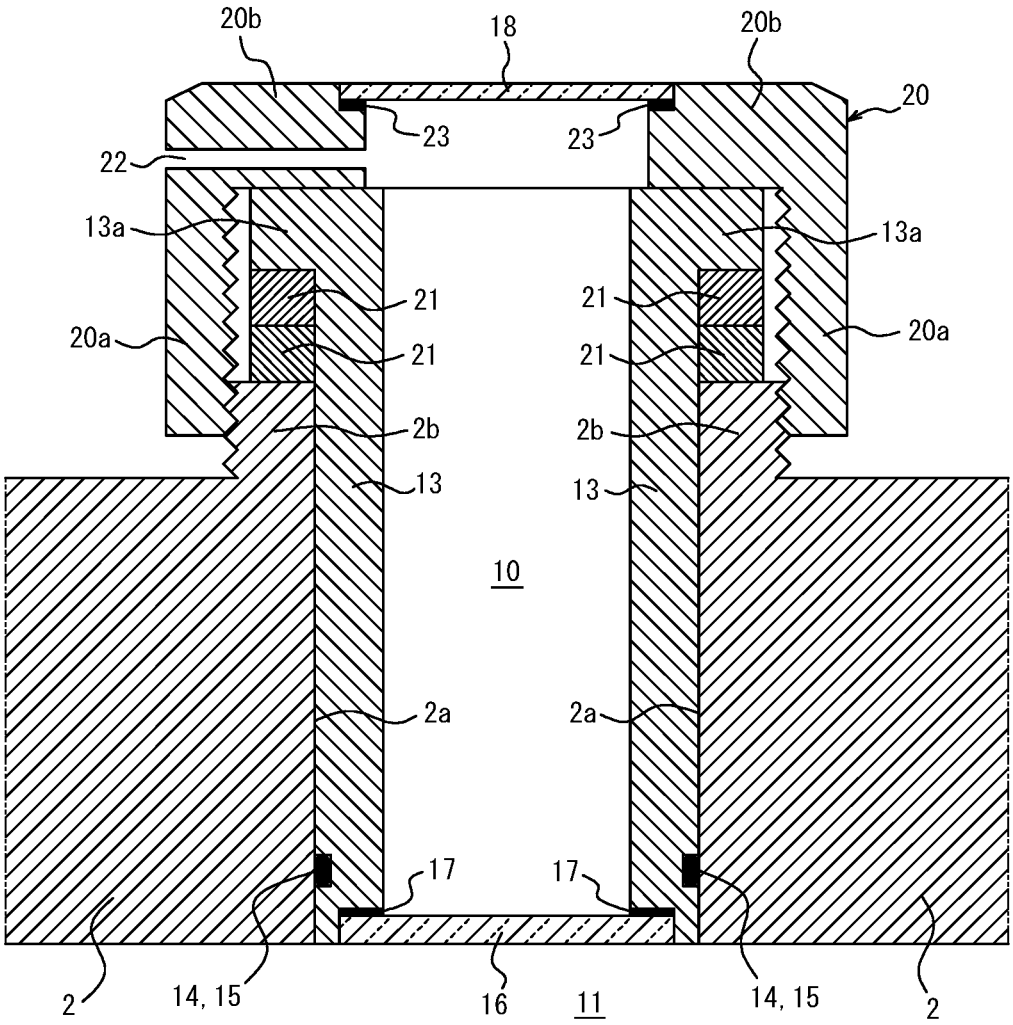
FIG. 3 is a diagram illustrating the main part of an example of a double-side polishing apparatus for a work, according to another embodiment of this disclosure.

FIG. 3 is a diagram illustrating the main part of an example of a double-side polishing apparatus for a work, according to another embodiment of this disclosure. The basic structure of the double-side polishing apparatus according to this alternative embodiment is the same as that of the double-side polishing apparatus depicted in FIG. 1, yet is different from the double-side polishing apparatus depicted in FIG. 1 in that the upper window 18 is provided on the upper member 20 (not the cylindrical member 13) and at least one (one in the illustration) vent 22 that makes the through hole 10 communicate with the outside is provided (in the upper member 20 in the illustration).

In the illustration, the upper window 18 having a plate shape is placed in a recessed part formed to have an annular shape at the upper end of the upper member 20. The lower surface of the upper window 18 and the upper surface of the upper member 20 (part 20*b*) that is defined by the above recessed part are bonded together using an adhesive layer 23. As in the case of FIG. 1, the upper window 18 may be made of, for example, a transparent acrylic material, and the adhesive layer 23 may use, for example, an adhesive layer made of a silicone-based or modified silicone-based adhesive.

The double-side polishing apparatus of this alternative embodiment is also chiefly provided with the through hole 10 in the upper plate 2, the opening 11 in the polishing pad 7, the lower window 16, and the upper window 18 as described above, and includes the work thickness measuring instrument 12, thus the thickness of the work (wafer in this example) can be measured in real time by the work thickness measuring instrument 12 through the upper window 18, the through hole 10 in the upper plate 2, the opening 11 in the polishing pad 7, and the lower window 16 during double-side polishing. Since the double-side polishing apparatus 1 of this alternative embodiment is also provided with the upper window 18, the attachment of soil (for example dust etc.) to the lower window 16 in a path for measuring the thickness of a work can be reduced.

Also in the embodiment illustrated in FIG. 3, since the lower window 16 and the upper window 18 are provided on the cylindrical member 13 and the upper member 20, respectively, but not on the surface plate, the windows can easily be replaced, which can reduce the running cost including the cost for cleaning; moreover, the backflow of the polishing slurry can be even more inhibited and the windows can be prevented from being coming off using an adhesive, for example, a strong adhesive such as a silicone-based or modified silicone-based adhesive. Further, since the cylindrical member 13 is made of metal (SUS in this example), favorable processing accuracy is achieved, and accurate processing by which the measurement accuracy is improved (for example, such as horizontally placing the window) can be performed.

Now, the studies made by the present inventors revealed that in the structures having the upper window 18 and the lower window 16 as illustrated in FIG. 1 and FIG. 3, fogging would occur in the path for measuring the thickness of a work. This could be attributed to that since the thermal conductivity of the metal (SUS) member is high and the upper window 16 and the lower window 18 form an enclosed structure, heat caused due to rubbing between the work and the polishing pad is likely to be accumulated in the through hole 10.

To address this, as in the embodiment illustrated in FIG. 3, at least one vent 22 that makes the through hole 10 communicate with the outside is provided thereby making steam or the like that causes fogging escape through the vent 22 or preventing the occurrence of fogging itself by avoiding the accumulation of heat. This can inhibit the measurement accuracy for the thickness of a work from being reduced.

The double-side polishing apparatus 1 preferably further incudes the upper member 20 fixed to an upper portion of the upper plate 2 or a lower member fixed to a lower portion of the lower plate 3. In the examples illustrated in FIGS. 1 to 3, the double-side polishing apparatus 1 includes the upper member 20 fixed to the projecting part 2*b* of the upper portion of the upper plate 2. Thus, the upper member 20 (or the lower member) is fixed to the upper portion of the upper plate 2 (or the lower portion of the lower plate 3) so that the upper window 18 (or the lower window 16) is detachable and covers the upper side (or the lower side) of the through hole. In the above example, as means to fix the surface plates and the (upper or a lower) member, a bolt and a nut are given as examples; alternatively, the surface plates and the (upper or lower) member used may have complementary shapes that fit each other. Further, the upper member and the lower member are preferably made of SUS because SUS is easily worked.

Further, it is also preferred that a part of the upper member 20 is placed on the upper surface of the cylindrical member 13 and the upper window 18 is provided on the upper member, or a part of the lower member is placed on the lower surface of the cylindrical member 13 and the lower window 16 is provided on the lower member.

Further, at least one vent 22 that makes the through hole 10 communicate with the outside is preferably provided. This can prevent fogging in the through hole 10. The vent 22 is provided in the upper member 20 in FIG. 3, yet may be provided on another member, for example, may be provided on the cylindrical member 13. Further, in the embodiment illustrated in FIG. 1, the through hole 10 is not provided; however, the through hole 10 may be provided for example on the cylindrical member 13 even in this case.

Further, it is preferred that the lower window 16 is bonded to a lower part of the cylindrical member 13 provided on the upper plate 2 using an adhesive (for example, a silicone-based or modified silicone-based adhesive), or the upper window 18 is bonded to an upper part of the cylindrical member 13 provided on the lower plate 3 using an adhesive (for example, a silicone-based or modified silicone-based adhesive). When an adhesive (a strong adhesive such as a silicone-based or modified silicone-based adhesive in particular) is used on the surface plates, the detachment operation is significantly difficult; however, the cylindrical member can preclude any significant influence on the workability during the detachment even when an adhesive (a silicone-based or modified silicone-based adhesive) is used. Examples of the silicone-based or modified silicone-based adhesive include, for example, but not limited to, Super Seal manufactured by CEMEDINE CO., LTD. Alternatively, it is possible that an adhesive is not used as below. Specifically, particularly when the cylindrical member 13 and the upper member 20 (lower member) are made of SUS, due to the ease of working, the cylindrical member 13 and the upper member 20 (lower member) are worked for example so as to fit the windows; thus, making the cylindrical member and the upper member (lower member) fit the windows can fix the windows and can meanwhile allow for easy replacement.

Further, it is also preferred that the recessed part 14 is provided on the outer circumferential surface of the cylindrical member 13 provided on the inner circumferential surface of the upper plate 2 and the O ring 15 is placed in the recessed part, or the recessed part 14 is provided on the outer circumferential surface of the cylindrical member 13 provided on the inner circumferential surface of the lower plate 3 and the O ring 15 is placed in the recessed part 14. The space between the inner circumferential surface of the surface plate 2(3) and the cylindrical member 13 is enclosed with the O ring 15, thus the backflow of the polishing slurry can be prevented.

Embodiments of this disclosure have been described above; however, this disclosure is in no way limited to the above embodiments. FIG. 1 to FIG. 3 particularly illustrate cases where the through hole 10 is provided in the upper plate 2; however, it is clear that this disclosure can also be applied to the case where the through hole 10 is provided in the lower plate 3 in a similar manner. By way of example, the metal (for example SUS) cylindrical member 13 may be provided on the inner circumferential surface of the lower plate 3, defined by the through hole 10. Further, the apparatus may also include the upper window 18 provided in an upper part of the cylindrical member 13 provided on the lower plate 3, and the lower window 16 provided to cover the lower side of the through hole 10 provided in the lower plate 3. Further, the apparatus may further include the lower member fixed to a lower portion of the lower plate 3. The lower member may be made of SUS. It may be that a part of the lower member is placed on the lower surface of the cylindrical member 13 and the lower window 16 is provided on the lower member. The upper window 18 may be bonded to an upper part of the cylindrical member 13 provided in the lower plate using an adhesive (for example, a silicone-based or modified silicone-based adhesive). It may be possible that the recessed part 14 is provided on the outer circumferential surface of the cylindrical member 13 provided on the inner circumferential surface of the lower plate 3, and the O ring 15 is placed in the recessed part 14.

REFERENCE SIGNS LIST

1: Double-side polishing apparatus
2: Upper plate
3: Lower plate;
4: Rotating surface plate
5: Sun gear
6: Internal gear
7: Polishing pad
8: Retainer opening
9: Carrier plate
10: Through hole
11: Opening
12: Work thickness measuring instrument
13: Cylindrical member
14: Recessed part
15: O ring
16: Lower window
17: Adhesive layer
18: Upper window
19: Gasket
20: Upper member
21: Washer
22: Vent
23: Adhesive layer

The invention claimed is:

1. A double-side polishing apparatus for a workpiece, comprising rotating surface plates having an upper plate and a lower plate, a sun gear provided at a central portion of the rotating surface plates, an internal gear provided around the rotating surface plates and the sun gear, and a carrier plate provided between the upper plate and the lower plate provided with at least one opening for holding the workpiece, wherein one of the upper plate and the lower plate has at least one through hole penetrating from an upper surface to a lower surface of said one of the upper plate and the lower plate, the double-side polishing apparatus for the workpiece further comprises at least one workpiece thickness measuring instrument that can measure a thickness of the workpiece through the at least one through hole during double-side polishing of the workpiece, an inner circumferential surface defined by the through hole in said one of the upper plate and the lower plate is provided with a metal cylindrical member, the double-side polishing apparatus for the workpiece further comprises either of:

a lower window provided in a lower part of the cylindrical member provided in the upper plate, an upper window provided in an upper part of the cylindrical member provided to cover an upper side of the through hole provided in the upper plate, and an upper member having an inner surface configured to be fixed to an outer surface of a projecting portion projecting from the upper surface of the upper plate, the cylindrical member having a first protruded portion and a part of the upper member is directly disposed on the first protruded portion; or an upper window provided in an upper part of the cylindrical member provided in the lower plate, a lower window provided to cover a lower side of the through hole provided in the lower plate, and a lower member having an inner surface configured to be fixed to an outer surface of a projecting portion projecting from the lower surface of the lower plate, the cylindrical member having a second protruded portion and a part of the lower member is directly disposed on the second protruded portion, and an other part of the upper member is placed on an upper surface of the cylindrical member, and the upper window is provided on the upper member; or an other part of the lower member is placed on a lower surface of the cylindrical member, and the lower window is provided on the lower member.

2. The double-side polishing apparatus for the workpiece, according to claim 1, wherein either of the upper member and the lower member are made of SUS.

3. The double-side polishing apparatus for the workpiece, according to claim 1, wherein at least one vent that makes the through hole communicate with the outside is provided.

4. The double-side polishing apparatus for the workpiece, according to claim 1, wherein the lower window is bonded to the lower part of the cylindrical member provided in the upper plate using an adhesive layer made of an adhesive; or the upper window is bonded to the upper part of the cylindrical member provided in the lower plate using an adhesive layer made of an adhesive.

5. The double-side polishing apparatus for the workpiece, according to claim 1, wherein a recessed part is provided in an outer circumferential surface of the cylindrical member provided on the inner circumferential surface of the upper plate and an O ring is placed in the recessed part, or a recessed part is provided in the outer circumferential surface of the cylindrical member provided on the inner circumferential surface of the lower plate.

* * * * *